US006767012B2

(12) United States Patent
Sasamoto

(10) Patent No.: US 6,767,012 B2
(45) Date of Patent: Jul. 27, 2004

(54) SHEET POST PROCESSING APPARATUS

(75) Inventor: Shinya Sasamoto, Fujii-chou Kitagejou (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 09/839,661

(22) Filed: Apr. 23, 2001

(65) Prior Publication Data

US 2004/0032073 A1 Feb. 19, 2004

(30) Foreign Application Priority Data

Apr. 24, 2000 (JP) ..... 2000-122425

(51) Int. Cl.[7] ..... B65H 31/34

(52) U.S. Cl. ..... 271/3.02; 271/3.03; 271/221; 399/407

(58) Field of Search ..... 271/3.02, 3.03, 271/221; 399/407–410

(56) References Cited

U.S. PATENT DOCUMENTS 6,179,287 B1 * 1/2001 Watanabe et al. ..... 271/215
6,302,389 B1 * 10/2001 Kato et al. ..... 270/58.13
6,427,997 B1 * 8/2002 Hirota et al. ..... 270/58.12
6,557,842 B2 * 5/2003 Conard-White et al. . 270/58.09

* cited by examiner

*Primary Examiner*—Christopher P. Ellis
*Assistant Examiner*—Mark A. Deuble
(74) *Attorney, Agent, or Firm*—James Creighton Wray; Meera P. Narasimhan

(57) ABSTRACT

A sheet finishing apparatus has a stacking tray for stacking sheets formed with indicia; a processing tray on the stacking tray for receiving sheets; a movable aligning plate on the processing tray that moves traverse to the direction of discharge of the sheets; with a plurality of aligning operations. The first aligning operation has a distance of L1 from the aligning position of the movable aligning plate to the first aligning operation starting position. The last aligning operation is a distance of L2 from the aligning position of the movable aligning plate to the final aligning operation starting position. L1>L2 for the last sheet of a plurality of sheets in a set. A first and second aligning operation are performed on each of a set of sheets. The distance from the aligning position in the second aligning operation to the aligning start position is L1, wherein L1>L2>L3.

2 Claims, 8 Drawing Sheets

SHEET POST PROCESSING APPARATUS

BACKGROUND OF THE INVENTION

1. Field of the Invention

This invention relates to a sheet-sorting apparatus for sorting sheets discharged from a copy machine, printer or an image-processing device equipped with a function for finishing such stapling or the punching of holes.

2. Description of the Related Arts

We will explain sheet finishing apparatuses of the past that have accompanied image processing units to align a set of sheets and to staple them.

Sheet finishing apparatuses have a stacking tray for the final stacking of sheets having indicia formed thereupon and a processing tray established in the process to transport to the stacking tray. Sheets formed with images are stacked temporarily on a processing tray. Furthermore, sheets are aligned on this processing tray and then discharged to the stacking tray after having been stapled.

Next, we shall explain the aligning process on this processing tray according to FIG. 8. A movable aligning plate a and a fixed aligning plate f are mounted in opposition to each other on the processing tray. The movable aligning plate a is movable in the direction to narrow the gap of opposition with the fixed aligning plate f, in other words, it is movable in the direction which transverses that of the direction of sheet discharge.

Furthermore, in FIG. 8, the numbers of 1 to 7 indicate the procedures for aligning sheets. Numbers 1 to 3 are the procedures for aligning the nth sheet S (n−1) and 4 to 7 are the final sheet S.

Sheet aligning is performed for each sheet, from the first sheet S to the nth sheet stacked on the processing tray. In other words, the movable aligning plate a starts at process 1 to strike the side edge of sheet S. This pushes the sheet S to the fixed aligning plate f, as shown in the procedure 2.

When the sheet S has been pushed against fixed aligning plate f, the movable aligning plate a returns to its original starting position again, as shown in procedure 3.

Then, another sheet S is led to the top of the prior sheet on the processing tray, and the movable aligning plate a again moves from its starting position to strike the side edge of the sheet S that has been newly led to the processing tray, to repeat the procedures of 1 to 3.

In this way, the repetitions of procedures 1 to 3 align the edges of the sheets while striking the edges of a plurality of sheets stacked on the processing tray.

Also, the movable aligning plate a aligns the nth and final sheet Sn using the procedures of 4 to 7 as shown in FIG. 8. In other words, when the final sheet Sn is led to the processing tray the movable aligning plate a starts the operation of procedure 4. In this way, the movable aligning plate a starts to strike the side edge of sheet Sn to push the sheet S against the fixed aligning plate f, as shown in procedure 5.

When the sheet Sn is pushed against the fixed aligning plate f, the movable aligning plate a returns to its starting position again, as shown in procedure 6, and again strikes the side edge of Sn as shown in procedure 7 to align the sheets.

The following are the reasons for striking the side edge of the final sheet Sn two times in repetition. Specifically, the aligning process for the sheets S other than the final sheet Sn is performed each time the sheet S is stacked on the processing tray. Therefore, all sheets are aligned a plurality of times for the number of times that sheets are stacked in repetition. The sheet edges will be correctly aligned the more times that this aligning process is repeated.

In respect to this, because the final sheet Sn is not stacked upon by any more sheets, the aligning process will only be performed once for that final sheet if the aligning process is not performed more than two times. However, there are cases in which it will not be done correctly if the aligning process is only performed one time. For that reason, in order to correctly align the sheets, including the final sheet Sn, the aligning process is performed specially for a second time.

Furthermore, on the apparatuses of the past, the distance of movement of the movable aligning plate a, in other words, from the starting position to the sheet striking position, had to be completely the same for sheets for the first sheet to the nth sheet and for the final sheet Sn.

In the same way as above, when aligning the nth sheet, the distance of movement for the movable aligning plate a, in other words, the distance from the starting position to the striking position, had to be completely the same for all sheets from the first sheet to the nth sheet. If the distance from the movable aligning plate a starting position to the sheet striking position is the same, so is the strength of the striking against the sheet the same.

However, when trying to align sheets, it is easier to align the sheets if there is some strength applied to the force of the strike. For example, if the sheet is greatly out of line, it is good to strike the sheet with some force. On the other hand if it is only slightly out of line, only a light force is required. The reason is that if you strike a sheet that is only slightly out of line with a great force, it will rebound from the fixed aligning plate f and become greatly out of line.

However, in apparatuses of the past, the force with which sheets have been struck has always been the same without any variation to the strength, thereby creating a situation in which sheet sets would not be correctly aligned.

SUMMARY OF THE INVENTION

An object of this invention is to provide a sheet finishing apparatus with a superior aligning process for better aligning of sheets.

Another object of the invention is to provide a sheet processing apparatus having a stacking tray for stacking sheets with indicia formed thereupon, a processing tray to receive the above described sheets in the process leading to this stacking tray. An aligning plate on the processing tray moves in the direction which transverses the direction of sheet discharge to align the sheets. After a stapling means staples the aligned sheets, the sheet set is discharged to the stacking tray.

Still another object of the invention is to combine a plurality of aligning actions when aligning the final sheet of a plurality of sheets in the same set wherein the distance from the aligning position of the aligning plate in the first aligning action to the starting position of the first aligning action is called L1 and the distance from the aligning position of the aligning plate in the final aligning action to the starting position of the final aligning action is called L2, the distances having the relationship of L1>L2.

Another object of the present invention is for the final sheet to be the nth sheet wherein when aligning sheets from the first sheet to the n−1 sheet, a first and a second aligning operation are performed wherein the distance from the aligning position in the second aligning operation to the aligning start position is L3, the relationships between these distances being L1>L2>L3.

The combination of the differences in strength of force of the striking of the edge of the sheets allows for an increase in the alignment of the sheets.

The processing time from the first sheet to the (n−1) sheet is shorter, so it is possible to shorten the total processing time of the sheets formed with images.

Also, if the final sheet is fed to the processing tray, it is possible to expect better alignment of the leading set of sheets stacked even if the amount of offset is large.

DETAILED DESCRIPTION OF THE PREFERRED EMBODIMENTS

The following is a detailed explanation of the preferred embodiment of the present invention based on the figures provided.

Figure 1:
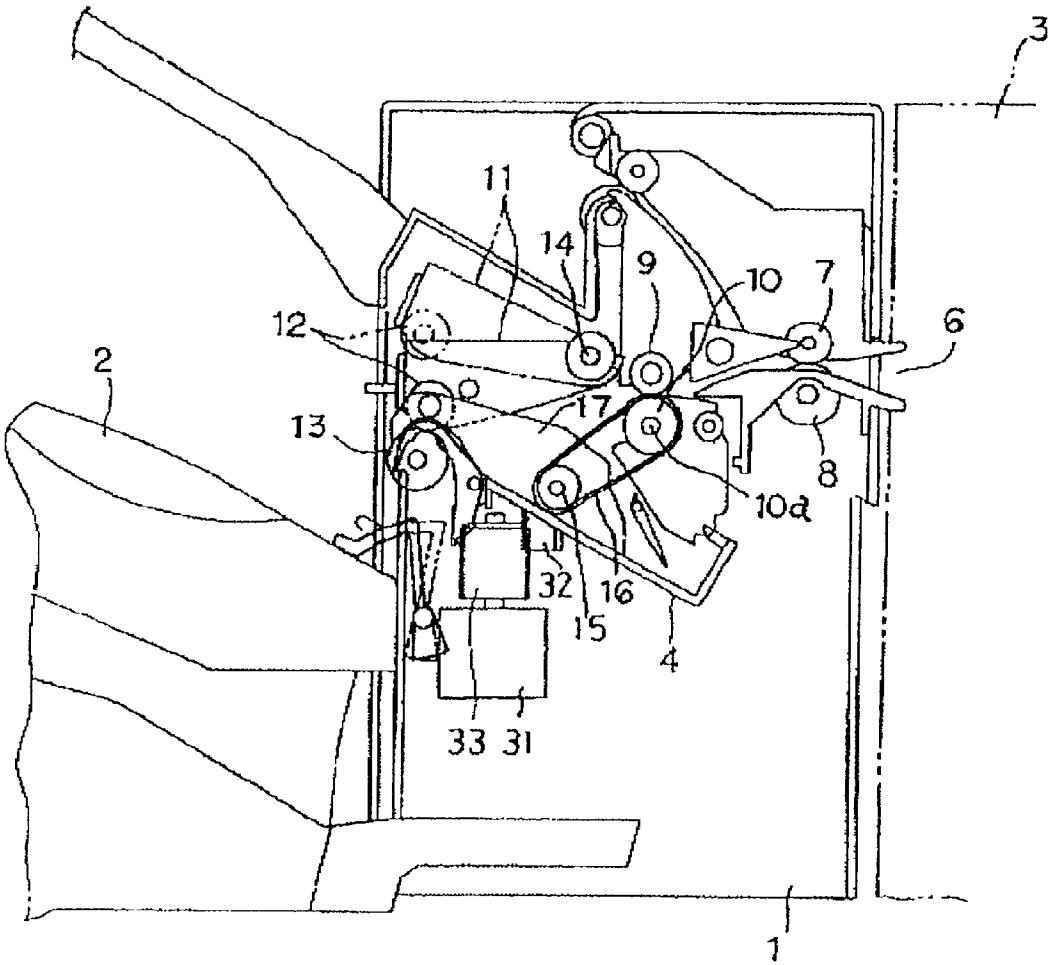
FIG. 1 is a side sectional view of the sheet finishing apparatus.

FIG. 1 showing the preferred embodiment of the invention is a sectional view of the sheet finishing apparatus. Sheet finishing apparatus 1 is established adjacent to an image forming apparatus 3 such as a copy machine or printer.

Sheets formed with indicia are transported into such a sheet finishing apparatus 1 via image forming apparatus 3 shown in FIG. 1. Sheets transported into the sheet finishing apparatus pass through a switch-back path transporting out to the stacking tray 2 via processing tray 4, are stapled or have holes punched therein and are discharged as a set.

The following provides a slightly detailed explanation of the sheet transport path. Sheets transported from the image forming apparatus as described above are fed in from the transport inlet 6 up to the transfer rollers 7 and 8. The transfer rollers 7 and 8 pull the sheet S into the sheet finishing apparatus 1 while rotating. Sheet S that has been pulled into the apparatus as just explained is pushed downstream by the intermediate transfer rollers 9 and 10 that are established downstream.

Figure 2:
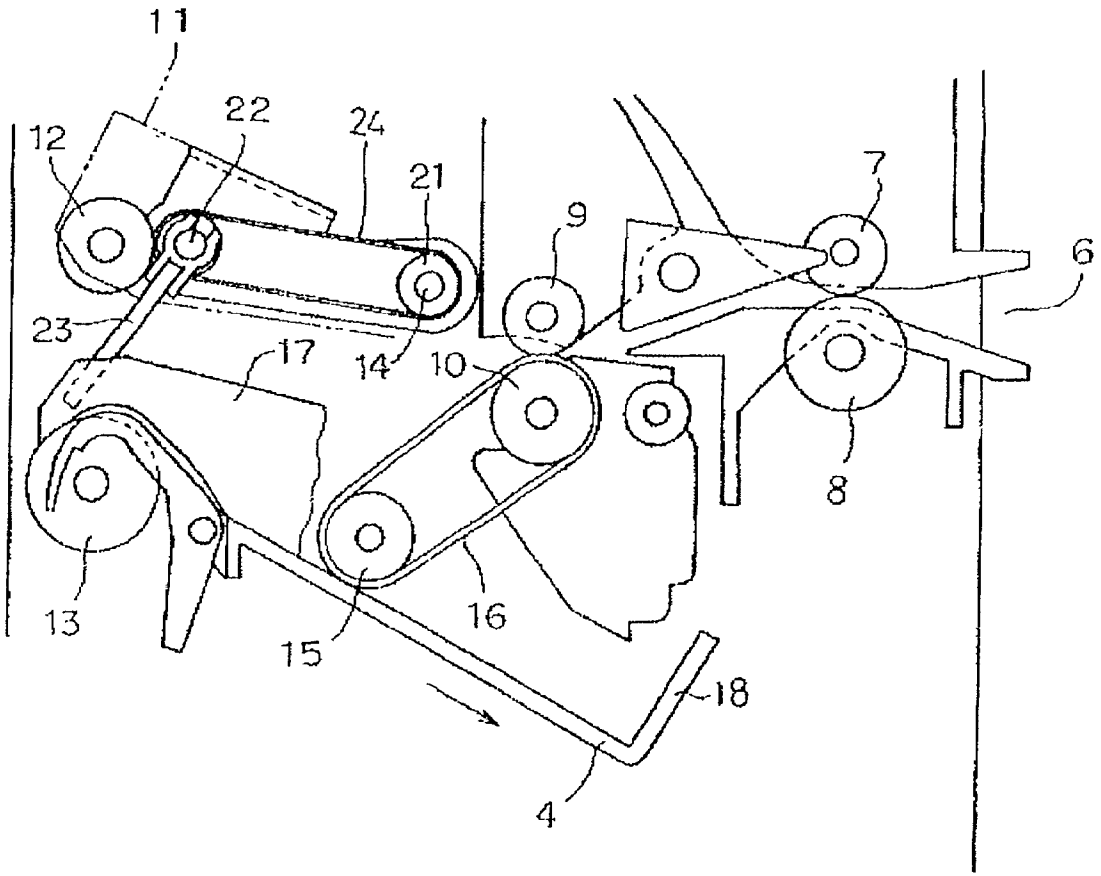
FIG. 2 is a sectional view of the essential portion of the path in the processing tray.

At this point, the rotating member 11 is maintained in a state as shown in FIG. 2. Therefore, the rising and lowering roller 12 maintains a position which is separated from drive roller 13.

Therefore, sheets that pass through intermediate transport rollers 9 and 10 are faced toward a portion of stacking tray 2 passing through drive roller 13 while being pushed out by those rollers of 9 and 10. Then, as the trailing edge of the sheets of the direction of its transport leave the intermediate transport rollers 9 and 10, the trailing edge of the sheets fall into the processing tray 4.

As the trailing edge of the sheets fall into the processing tray 4, drive roller 13 reverses its rotation while the paddle drive roller 21, which is fixed to the drive axis 14, rotates. This paddle drive roller 21 is interlocked to the paddle drive roller 22 which is fixed to paddle 23. Therefore, the rotation of the drive axis 14, rotates paddle 23. At this time, the rotating direction of the paddle is counter-clockwise in FIG. 2.

In the way described above, drive roller 13 reverses its rotation and paddle 23 rotates in the counter-clockwise in FIG. 2 so sheets that are on the drive roller 13 are transported in the direction of the arrow in FIG. 2 which is the processing tray 4. Furthermore, the lower edge of the transport belt 16 which is trained on the intermediate transport roller 10, which has just been described, contacts the sheet in processing tray 4 to transport it in the direction of the arrow in FIG. 2. The reason is that the intermediate transport roller 10 is rotating counter-clockwise around the center of the rotational axis 10*a,* and the rotation of the transport belt 16 trained on the auxiliary roller 15 also rotates in the counter-clockwise direction in FIG. 2, so the sheet S is transferred along the direction of the arrow. The transported sheet S is fed in the direction of stopper 18. In this way, the sheet fed to the processing tray 4 by the drive roller 13 and paddle 23 is fed further by the transport belt 16 to be put into the processing tray.

Next, we shall explain the aligning mechanism to align the side edges of the sheets put into the processing tray.

Figure 3:
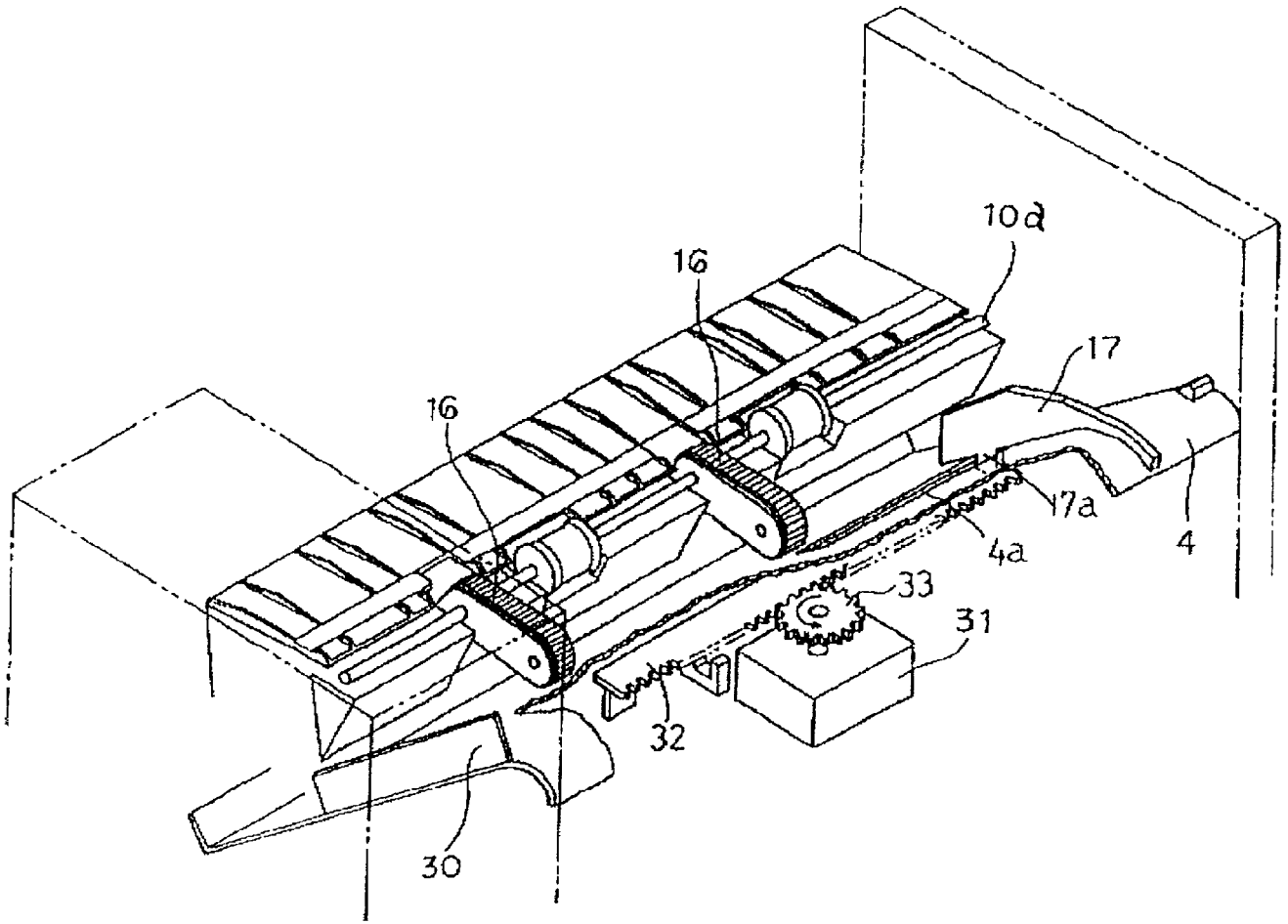
FIG. 3 is a perspective view of the processing tray with a portion removed.

FIG. 3 shows a perspective view of the part with the processing tray 4 removed. In FIG. 3, a movable aligning plate 17 is established on one side of the processing tray 4, and if fixed aligning plate 30 established in opposition to the movable aligning plate 17

The guide protrusion 17*a* formed on the lower side of said movable aligning plate 17 passes freely through the guide slit 4*a* formed on the process tray 4 and passing edge is fixed to rack member 32. The rack member 32 is movable established below process tray 4 along its with a direction and fits into pinion 33. The opinion 33 rotates by the drive motion of stepping motor 31.

Now, when the stepping motor 31 rotates in the direction of the arrow of FIG. 3, the rack member 32 moves in the left or right directions of the figure correspond to the amount of rotation of the stepping motor 31 The direction of this movement is transverse to the direction of sheet discharge.

If the rack member 32 moves to left direction of the figure, the movable aligning plate 17 moves in accordance. Therefore, by controlling the rotation amount of stepping motor 31, it is possible to determine the distance of travel of the movable aligning plate. Furthermore, not only can the distance of travel of the movable aligning plate be set, but so can the starting position of the movable aligning plate and the number of times of travel of the movable aligning plate be set.

Figure 4:
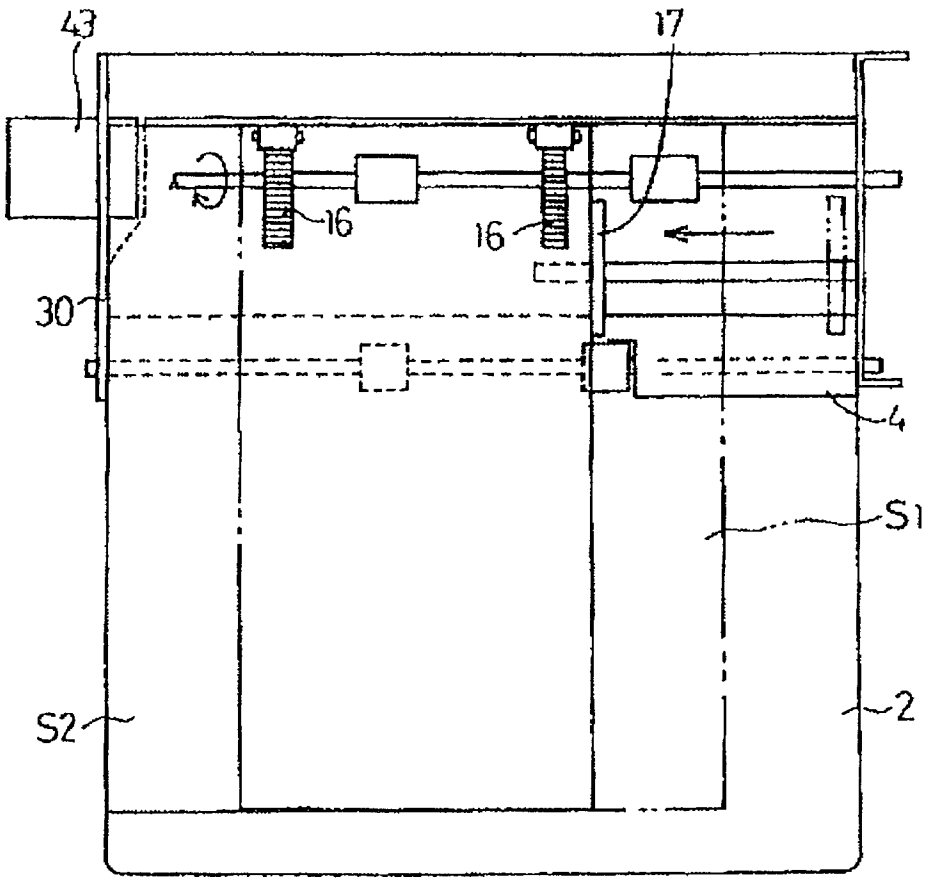
FIG. 4 is a plan view of the processing tray.

In this manner, the movable aligning plate 17 is moved to strike the edges of sheets between the movable aligning plate 17 and the fixed aligning plate 30, as shown in FIG. 4 to push them against the fixed aligning plate 30. The force with which the sheets are pushed against the fixed aligning plate 30 differs according to the distance of travel of the movable aligning plate 17. In other words, as the distance of travel of the movable aligning plate 17 increases, so does the force with which the sheets are pushed against the fixed aligning plate 30.

If the distance of travel of the movable aligning plate 17 is large, the time for the movable aligning plate 17 to travel increases thereby increasing the amount of time to perform the aligning operation. Also, if the distance of travel of the movable aligning plate 17 is large, more time is required for the movable aligning plate 17 to return from the aligning position to the aligning starting position.

Also, the position of the movable aligning plate 17 when pushing the edge of the sheet against the fixed aligning plate 30 is the aligning position.

So, in this way, the edges of the sheet S2 that has been pushed against the fixed aligning plate 30 are aligned by the pressing force of the movable aligning plate 17. It is in this state that plurality of sheets are stapled or have holes punched therein. The number 43 in FIG. 4 represents the stapler which is the binding means. So, if the stapling or the hole punching of the set of sheets is performed while the edges of the sheets are perfectly aligned, the set of bound sheets will be completed with all sheets and the hole punches perfectly aligned.

Figure 5:
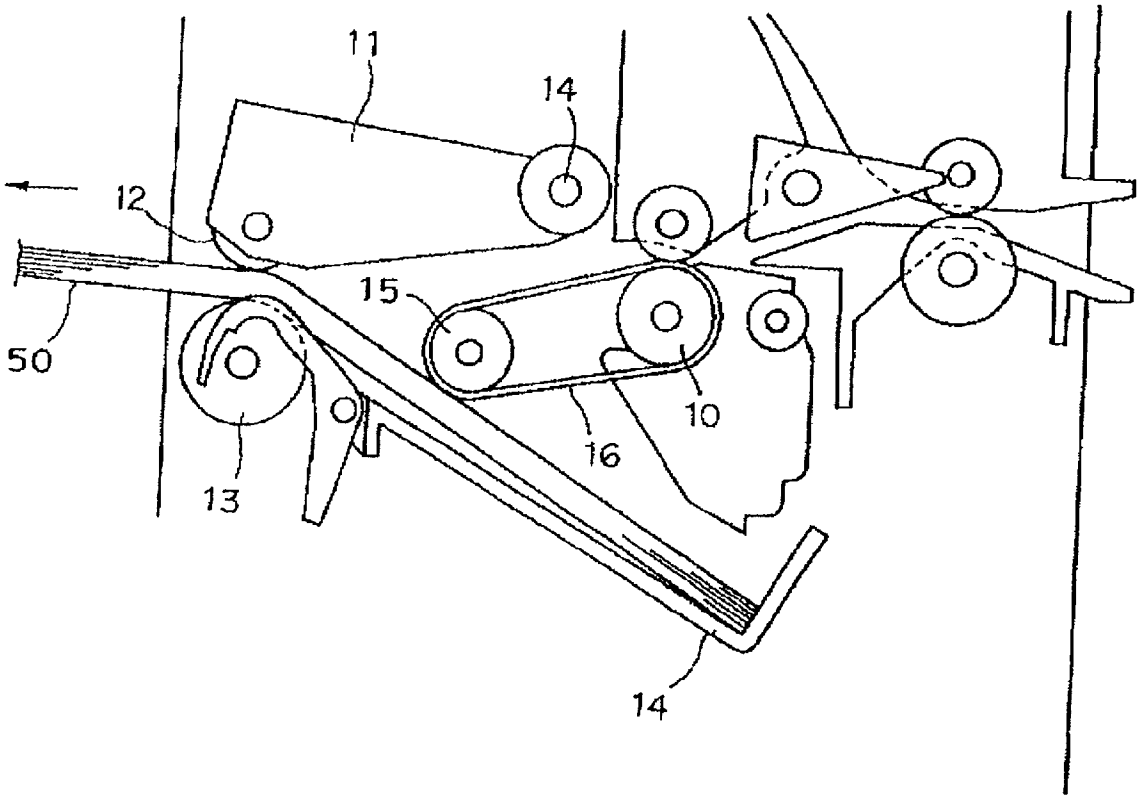
FIG. 5 is a sectional view of the part showing the status of the discharged set.

Next, we will use FIG. 5 to explain the sheet bundle stacked on the processing tray 4 and mechanism to discharge that bundle all at once to the stacking tray 2.

FIG. 5 is a sectional view of the main mechanism of the sheet finishing apparatus of FIG. 1. Furthermore, the stacking tray 2 is positioned in the location in the front of the direction of the arrow in FIG. 5.

In this apparatus, the entire sheet set 50 stacked on the processing tray 4 is discharged to the stacking tray 2 by being gripped between the rising and lowering roller 12 and the drive roller 13, but the timing for the pressing by the rising and lowering roller 12 against the sheet set is determined by the following.

Namely, when sorting sheets that have been processed with images, the number of sheets that comprise that set is stored in memory in advance. Then, when the finishing operation of the sheet set is completed, the rotating member 11 rotates in the counter-clockwise in FIG. 2. In this way, when the rotating member 11 rotates in the counter-clockwise direction, the rising and lowering roller 12 presses against the sheet set that is on the drive roller 13, as shown in FIG. 5.

In this state, by rotating the drive roller 13, the sheet set 50 which is stacked on the processing tray 4 is transferred to the stacking tray 2.

Figure 6:
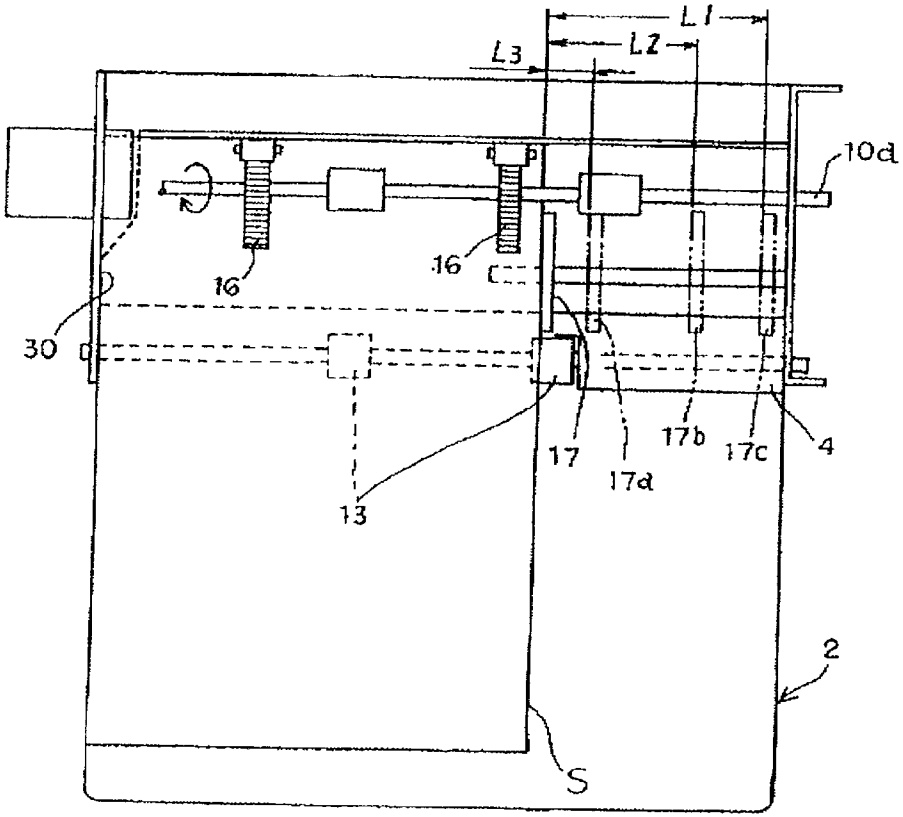
FIG. 6 is a plan view of the processing tray showing the starting position of the movable aligning plate.
Figure 7:
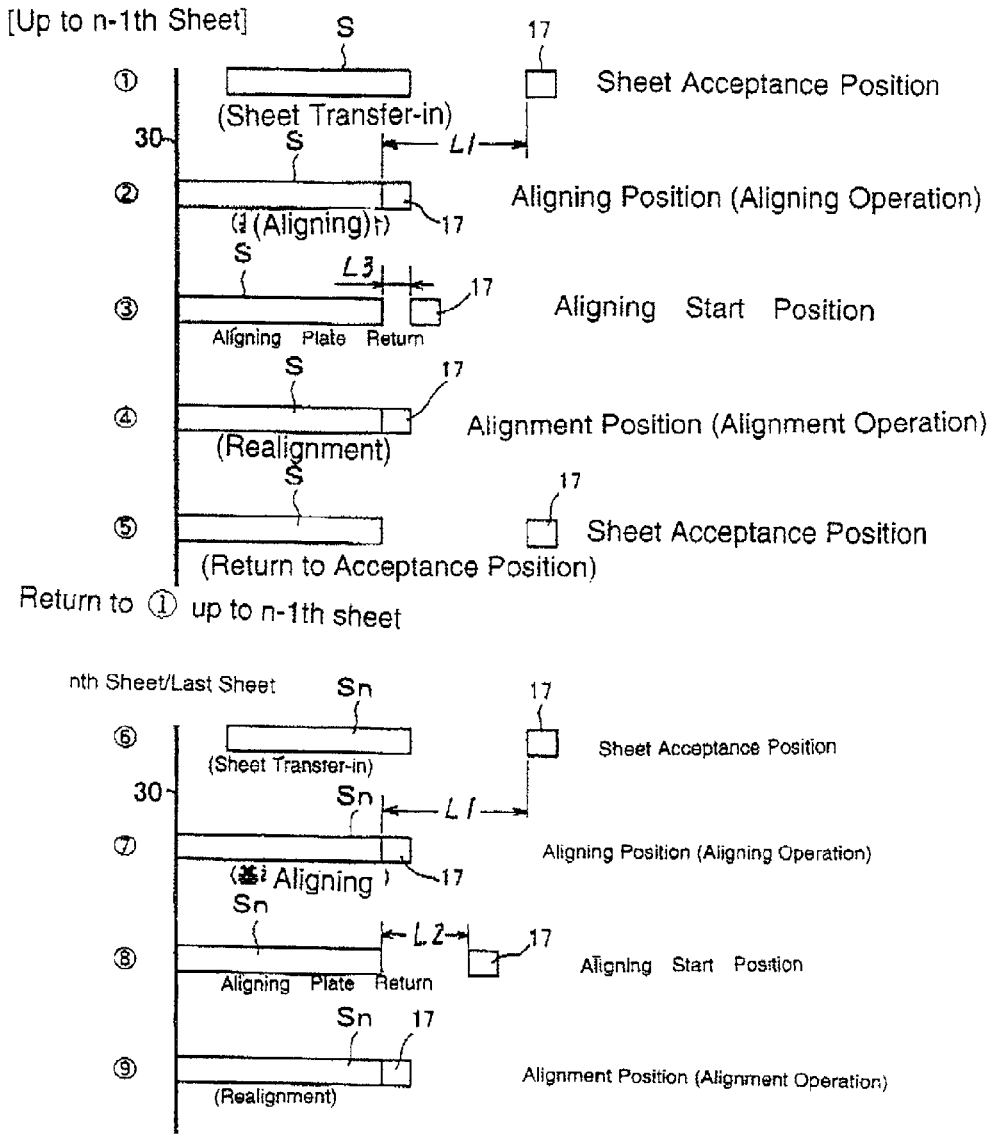
FIG. 7 is a drawing showing the aligning operation in the processing tray of the preferred embodiment.
Figure 8:
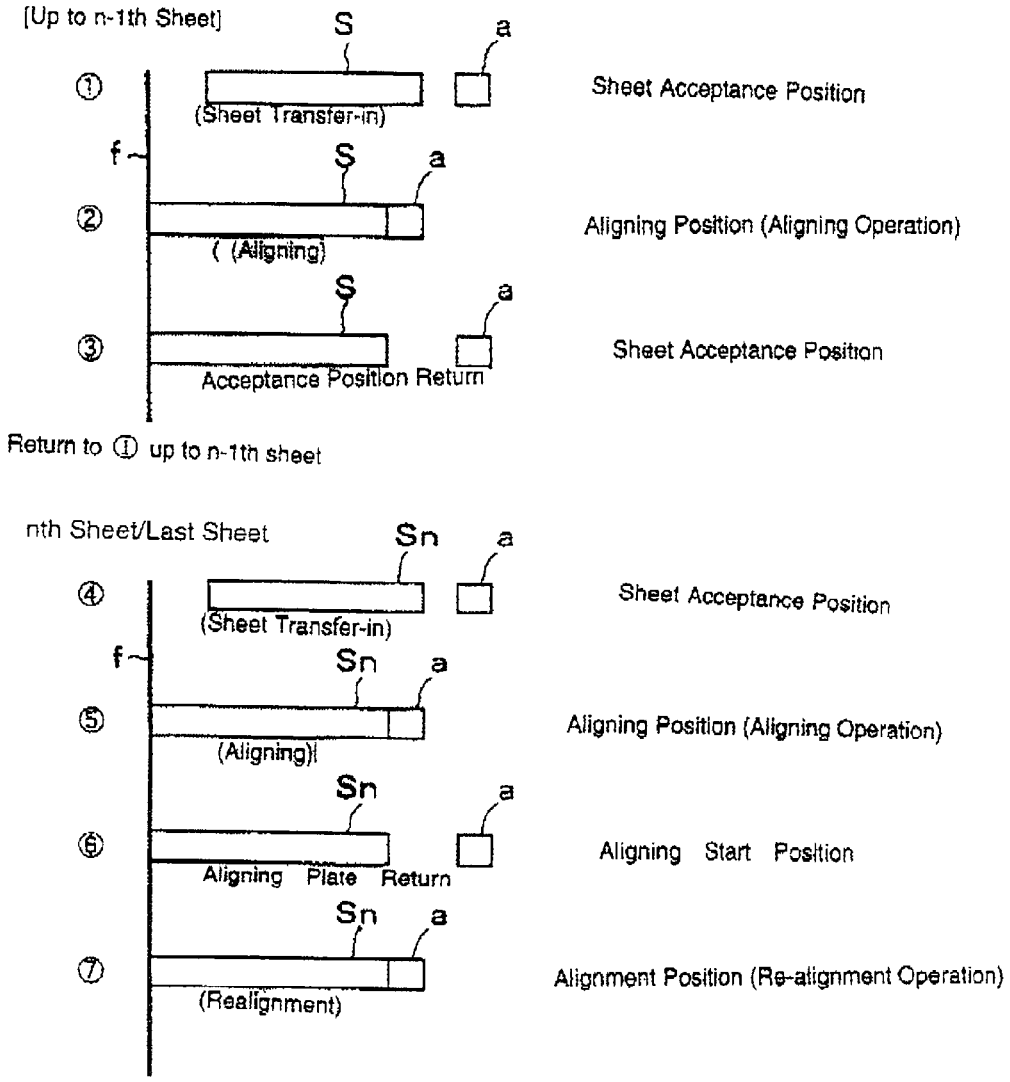
FIG. 8 is a drawing showing the aligning operation in the processing tray of the prior art.

The following explains how the nth sheet transferred from the image forming apparatus is aligned and the finishing process using FIG. 6 and FIG. 7.

FIG. 6 shows a plan view of the stacking tray 2 and processing tray 4. The fixed aligning plate 30 is established on one side of the processing tray 4 and the movable aligning plate 17 is established on the opposite side as described above.

However, in FIG. 6, the unbroken line indicating the movable aligning plate 17 is the state showing the aligning position at the point where the aligning operation has been completed.

The dotted line indicating the movable aligning plate 17*c* position is the starting position of the first aligning operation. The 17*b* position is the starting position of the final aligning operation and the 17*a* position is the starting position of the second aligning operation.

Furthermore, in FIG. 7, the numbers of 1 to 9 indicate the procedures for aligning sheets. Numbers 1 to 5 are the procedures for aligning the nth sheet S (N−1) and 6 to 9 are the final sheet S.

Sheet aligning is performed for each sheet stacked on the processing tray 4, from the first sheet S to the nth sheet stacked on the processing tray. In other words, the movable aligning plate 17 at procedure 1 strikes the side edge of the sheet S starting from the starting position 17*c* of the first aligning operation. This pushes the sheet S to the fixed aligning plate 30, as shown in the procedure 2. The distance from the starting position 17*c* of the first aligning operation to the above mentioned aligning position is L1.

When the sheet S is pushed against the fixed aligning plate 30 in the procedure 2, the movable aligning plate 17 moves from the aligning position to the starting position 17*a* of the second aligning operation of procedure 3. The distance from this starting position to the above mentioned aligning position is L3.

Then, the movable aligning plate 17 starts from the starting position of the starting position 17*c* of the second aligning operation. In this way, the movable aligning plate 17 starts and by striking the side edge of the sheet S, the sheet S is again pushed against the fixed aligning plate 30, as shown in procedure 4.

Again, the above distances of L1 and L3 have a relationship in which L1>L3.

The aligning operation is repeated on the one sheet S two times while a difference is made between the starting position 17*c* of the first aligning operation and the starting position 17*a* of the second aligning operation to apply a different amount of force to the striking of the movable aligning plate 17 between the first and the second aligning operations. In other words, the striking of the side edge of the sheet S by the movable aligning plate 17 from the starting position 17*c* of the first aligning operation moving the distance of L1 applies more force than the striking of the side edge of the sheet S by the movable aligning plate 17 from moving the shorter distance of L3.

Also, when another sheet S is led to the top of the prior sheet on the processing tray, and the movable aligning plate 17 again moves from its starting position to strike the side edge of the sheet S that has been newly led to the processing tray, to repeat the procedures of 1 to 5.

A plurality of aligning operations are thus performed with varying amounts of force. For that reason, it is possible to expect the effect of increased alignment by the combining aligning operations having differing amounts of force. In other words, in the aligning operation in which the striking of the side edge of the sheet applies a strong force, any largely offset sheets are aligned, and conversely, lightly striking the side edges of sheets will enable slight amounts of aligning of sheets.

In this way, the repetition of procedures 1 to 5 aligns the edge of the sheets up the (n−1) sheets while striking the edges of a plurality of sheets stacked on the processing tray to align the sides of the sheets.

Also, the movable aligning plate 17 aligns the nth and final sheet Sn using the procedures of 6 to 9 as shown in FIG. 7. In other words, when the final sheet Sn is led to the processing tray the movable aligning plate 17 starts the operation of procedure 6. In this way, the movable aligning plate 17 starts to strike the side edge of sheet Sn to push the sheet Sn against the fixed aligning plate 30, as shown in procedure 7. Here, the starting position of the movable aligning plate 17 in procedures 6 and 7 is 17*c*. Therefore, in the first aligning operation, the movable aligning plate 17 moves only the distance of L1.

In this way, moving the movable aligning plate 17 the distance of L1 and using that amount of force will allow a large alignment of the final sheet.

Furthermore, when the sheet Sn is pushed against the fixed aligning plate 30, the movable aligning plate 17 returns to its starting position again, as shown in procedure 8, then moves to the L2 position separated from the aligning position, then again strikes the side edge of Sn as shown in procedure 9 to align the sheets. Also, the movable aligning plate 17 travels the distance of L2 to perform the aligning operation for the final time.

It is in this state that plurality of sheets are stapled or processed with holes therein, not shown in the drawings.

The distances of L2 and L1 should preferably have the relationship of L2<L1. That is so that the same effect as from the first sheet to the (n−1) can be expected. For that reason, it is possible to expect the effect of increased alignment by the combining aligning operations having differing amounts of force.

With regard to the final sheet Sn, repetition of the aligning operation more than two times is necessary. For example, regarding the sheets S from the first sheet to the (n−1) sheet, more sheets are being stacked thereupon, so in the case of the first sheet, the aligning operation is applied to that first sheet at least two times.

However, the final sheet Sn is not stacked upon by another sheet, so that final sheet Sn is struck only the number of times of the aligning operation. Therefore, with regard to the final sheet Sn, repetition of the aligning operation more than two times is necessary.

Also, the distance of travel L2 of the movable aligning plate 17 in the final process preferably has a relationship of L2>L3. This does not mean that the aligning operation for the final sheet Sn in the above description occurs many times. Therefore, in the final aligning operation, the edges of the sheets must be correctly aligned. To correctly align the edges of the sheets, it is effective to apply as strong a force as possible to the striking of the side edges of the sheets by the movable aligning plate 17 in the final aligning operation. A stepping motor requires some distance to reach its maximum speed, which is the maximum force with which it will drive the movable aligning plate 17 toward the edge of the set of sheets.

In that case, in order to apply as strong a force to the final aligning operation of the movable aligning plate 17, it is preferable for the relationship of the distances of travel of L2 and L3 to be L2>L3.

So, if the stapling or the hole punching of the set of sheets is performed while the edges of the sheets are perfectly aligned, the set of bound sheets will be completed with all sheets and the hole punches perfectly aligned.

Furthermore, with regard to all of the sheets from the first sheet to the (n−1) sheet, if the movable aligning plate 17 is moved only the distance of travel of L2, a lot of time is required for that amount of travel as the distance is longer, thereby causing the processing time to be that much longer. Also, with regard to the sheets from the first sheet to the (n−1) sheet, because the aligning operation is performed for the number of sheets stacked, even for 1 process, the processing time is longer, thereby greatly affecting the entire process.

So, if the relationship between the distances of travel of L2 and L3 is L2>L3, the total processing time can be shorted while improving the alignment of sheets even if the amount of offset of the leading sheets stacked first is large if the final sheets are fed to the processing tray.

In the system just described, the distance of travel of the movable aligning plate 17 in the first aligning operation is L1, the distance of travel of the movable aligning plate 17 in the second aligning operation is L3 and the relation of the distance of travel L2 of the movable aligning plate 17 in the final aligning operation is preferably L1>L2>L3.

What is claimed is:

1. In a sheet finishing apparatus having a stacking tray for stacking sheets formed with indicia, a processing tray established in the process to said stacking tray for receiving said sheets, a movable aligning plate established on said processing tray to traverse in movement the discharge direction of said sheets for sheet alignment, a binding means for binding said aligned sheets, the finishing apparatus discharging sheets to a stacking tray wherein;

the aligning of the last sheet of a plurality of sheets employs a plurality of aligning operations, the first aligning operation having a distance from the aligning position of said movable aligning plate to the first aligning operation starting position of L1;

the last aligning operation a distance from the aligning position of the movable aligning plate to the final aligning operation starting position of L2, the relationship between the two distances is L1>L2.

2. The sheet-sorting apparatus of claim 1 wherein the final nth sheet and when aligning sheets from the first sheet to the n−1 sheet, a first and a second aligning operation are performed wherein;

the distance from the aligning position in the second aligning operation to the aligning start position is L3, the relationships between these distances is L1>L2>L3.

* * * * *